US008382115B2

(12) United States Patent
Moody

(10) Patent No.: US 8,382,115 B2
(45) Date of Patent: Feb. 26, 2013

(54) PRINTING PLAYING CARDS AT A GAMING TABLE

(75) Inventor: Ernest W Moody, Las Vegas, NV (US)

(73) Assignee: Ernest Moody Revocable Trust, Las Vegas, NV (US)

( * ) Notice: Subject to any disclaimer, the term of this patent is extended or adjusted under 35 U.S.C. 154(b) by 1198 days.

(21) Appl. No.: 11/951,303

(22) Filed: Dec. 5, 2007

(65) Prior Publication Data

US 2008/0150231 A1 Jun. 26, 2008

Related U.S. Application Data

(60) Provisional application No. 60/873,307, filed on Dec. 6, 2006.

(51) Int. Cl.
*A63F 1/14* (2006.01)
*A63F 1/12* (2006.01)

(52) U.S. Cl. ..... 273/309; 273/149 R; 273/139; 273/138.2

(58) Field of Classification Search ..... 273/149 R, 273/138.2, 309, 139
See application file for complete search history.

(56) References Cited

U.S. PATENT DOCUMENTS

| | | | | |
|---|---|---|---|---|
| 5,199,710 | A | 4/1993 | Lamle | |
| 6,638,161 | B2 | 10/2003 | Soltys et al. | |
| 6,886,829 | B2 | 5/2005 | Hessing et al. | |
| 6,991,540 | B2 * | 1/2006 | Marlow | 463/16 |
| 2002/0155869 | A1 | 10/2002 | Soltys et al. | |
| 2003/0064767 | A1 * | 4/2003 | Brown | 463/12 |
| 2006/0205519 | A1 | 9/2006 | Soltys | |

* cited by examiner

*Primary Examiner* — Benjamin Layno
(74) *Attorney, Agent, or Firm* — John Edward Roethel

(57) ABSTRACT

A gaming table is provided with an associated playing card printer. At the beginning of play, the playing card printer prints an entire deck of playing cards on suitable card stock. The deck of playing cards is printed in a random order as determined by a random number generator. The deck of playing cards is collated into a stack of cards and presented to the dealer who then uses this deck of playing cards to deal the casino game.

2 Claims, No Drawings

PRINTING PLAYING CARDS AT A GAMING TABLE

CROSS-REFERENCE TO RELATED APPLICATION

This application is based on and claims the benefit of U.S. provisional patent application Ser. No. 60/873,307, filed Dec. 6, 2007, the disclosure of which is incorporated herein in its entirety.

This application relates to printing playing cards for a casino table game, such as Baccarat, at the gaming table, and more particularly to printing an entire deck of playing cards at the gaming table.

BACKGROUND OF THE INVENTION

Traditionally live casino card games, such as Baccarat and Twenty-One, use one or more decks of playing cards that are obtained from companies that manufacture the playing cards, bundle the playing cards together into a deck of playing cards and then seal the box holding the deck of playing cards. When the box of a deck of playing cards arrives at the gaming establishment, the box is traditionally first opened at the gaming table at which the cards are to be used.

The dealer, while being supervised by a floor person and casino video surveillance, extracts the deck of playing cards from the box, exposes all of the cards and checks to ensure a complete deck is present. The dealer then shuffles the deck of playing cards and then the play of the casino game may commence. Whenever the playing cards are changed, no play of the casino game occurs which lowers the casino revenue and annoys the players who have to wait for the new deck to be examined and shuffled. In games in which multiple decks of cards are used (such as 4, 6 or even 8 deck Twenty-One games), the delay can be quite significant.

It has been proposed to print only the cards that are actually needed for a particular deal of the casino game. U.S. Pat. No. 5,199,710 (Lamle) discloses a method and apparatus for supplying playing cards at random to a casino table. A printer is associated with a gaming table and whenever playing cards are needed at the gaming table, the dealer activates the printer which randomly selects a card by suit and rank from the remaining cards available and that card is printed and dispensed to the dealer location from which the card may be passed to the player.

A drawback to the Lamle invention is that it does not print an entire deck of cards, but only prints a card at a time as needed in the game being played.

SUMMARY OF THE INVENTION

A gaming table is provided with an associated playing card printer. At the beginning of play, the playing card printer prints an entire deck of playing cards on suitable card stock. The deck of playing cards is printed in a random order as determined by a random number generator. The deck of playing cards is collated into a stack of cards and presented to the dealer who then uses this deck of playing cards to deal the casino game.

DETAILED DESCRIPTION OF THE PREFERRED EMBODIMENTS

A gaming table is provided with an associated playing card printer. The printer is connected to a computer control which controls the operation of the printer. Suitable operational buttons or switches are provided by which a casino dealer can effect the operation of the printer.

At desired times such as the beginning of play, the dealer activates the printer to cause the printer to print out an entire deck of playing cards on suitable card stock. Any suitable card stock may be used, but preferably a less expensive and less durable card stock than conventional card stock is used since the playing cards will only be used one time. Card stock without plastic coating may be used which would permit the card stock to be more easily recycled.

The deck of playing cards is printed in a random order as determined by a random number generator. The random order varies from game to game. This eliminates the time normally taken by the dealer in shuffling the cards and will increase the number of hands of the casino game that my be played in any particular time period.

The deck of playing cards is collated into a stack of cards and presented to the dealer who then uses this deck of playing cards to deal the casino game. The computer controls ensure that a random distribution of the cards will occur throughout the deck and this will minimize the possibility that the dealer could manipulate the sequence of cards in the deck since the dealer will not be shuffling the deck of cards.

The present invention is particularly valuable when used in connection with high stakes Baccarat games. Traditionally, a new deck of cards is used after every deal in high stakes Baccarat. This is time consuming since an inspection of the deck and shuffling is required whenever a new deck of cards is introduced into the game. By printing a new deck of cards in a random order prior to each deal of a hand of Baccarat, the time between hands can be shortened considerably. Because the printing of the new deck can occur during the time of play of the ongoing Baccarat hand, the deal of the next Baccarat hand can be commenced almost immediately following the completion of the previous hand.

While the invention has been illustrated with respect to several specific embodiments thereof, these embodiments should be considered as illustrative rather than limiting. Various modifications and additions may be made and will be apparent to those skilled in the art.

What is claimed is:

1. A method of dealing playing cards at a gaming table comprising:

a) providing a gaming table and a playing card printer associated with the gaming table;

b) prior to the start of a card game at the gaming table, activating the playing card printer to print out an entire deck of playing cards on suitable card stock; the entire deck of playing cards being printed in a random order that varies from game to game;

c) collating the entire deck of printed playing cards so that a dealer may use this deck to deal a card game.

2. The method of claim 1 in which the card game is Baccarat and a new entire deck of playing cards is printed and used in the Baccarat game for each hand of the Baccarat game.

* * * * *